US005975005A

United States Patent [19]

Yoshioka

[11] Patent Number: 5,975,005

[45] Date of Patent: Nov. 2, 1999

[54] FOLDABLE BOAT

[76] Inventor: Yasuo Yoshioka, 2-7-1 Unobe Osaka-Fu, Ibaraki, Japan, F567

[21] Appl. No.: 09/025,337

[22] Filed: Feb. 18, 1998

[30] Foreign Application Priority Data

Feb. 19, 1997 [JP] Japan ..... 9-052471

[51] Int. Cl.[6] ..... B63B 7/00

[52] U.S. Cl. ..... 114/353; 114/354

[58] Field of Search ..... 114/343, 352–354, 114/77 R, 77 A

[56] References Cited

U.S. PATENT DOCUMENTS 1,549,153 8/1925 Scheff ..... 114/352
2,129,788 9/1938 Scruggs ..... 114/352
2,271,338 1/1942 Hamlin, Jr. ..... 114/354
4,706,597 11/1987 Figone ..... 114/353

*Primary Examiner*—Ed Swinehart
*Attorney, Agent, or Firm*—Morrison Law Firm

[57] ABSTRACT

A foldable boat has a hull divided into at least three sections; one of which includes at least one hull forming member. Each hull forming member has a bottom forming member with side forming members rotatably mounted thereon. Flexible members extend through the hull forming members and attach on the other remaining two sections of the hull. When the flexible members are pulled and fastened, the hull forming members are forced together thereby forming a hull. When the flexible members are not attached, the boat can be folded and transported easily. The side forming members are foldable flat against their respective bottom forming members and adjacent bottom forming members are foldable flat against each other to provide a compact folded configuration.

10 Claims, 12 Drawing Sheets

FOLDABLE BOAT

BACKGROUND OF THE INVENTION

The present invention relates to a compact foldable boat. In particular, the present invention relates to a foldable boat that is comfortable and stable during use.

Various types of foldable boats are known. In one type of foldable boat, a frame is used to provide the outer shape of a hull. A waterproof fabric covers over the frame. Japanese laid-open patent publication number 1-233190 and Japanese laid-open patent publication number 6-48376 also describe types of foldable boats. In the foldable boat disclosed in Japanese laid-open patent publication number 1-233190, an outer hull plate is formed by joining a fiberglass-reinforced synthetic resin and a synthetic fiber cloth. A box filled with a synthetic foam resin is attached to the outer side of the outer hull plate, and a reinforcement frame is attached inside the boat. The foldable boat disclosed in Japanese laid-open patent publication number 6-48376 has a pair of bottom panels and a pair of side panels hinged to these bottom panels. Each panel has an edge at the back end. A flexible sectional plate has a fold line, a flange to the bottom rear and a pair of side-edge flanges. The connecting section between the sectional plates and the edges at the back end of a panel are sealed to prevent the boat from leaking at the folds and the connecting sections. The flanges of the sectional plates are joined via joining means to the edges at the back ends of the panels.

In conventional foldable boats where a frame is used to form the outer shape of the hull and a waterproof cloth covers the frame, a large number of parts is required and assembly is complicated and time-consuming. Since the bottom is formed using pipes, movement on the boat must be along the frame, which is unstable and dangerous. Also, in the foldable boat disclosed in Japanese laid-open patent publication number 1-233190, where the joining section is waterproofed, the number ofjoints is reduced and a stiffener filled with bulky foam resin (made from FRP board into which synthetic resin is foamed into long, thin boxes) is used. Thus, the boat is not compact when folded. The boat requires a lot of space for storage, and transporting the boat is inconvenient. In the foldable boat disclosed in Japanese laid-open patent publication number 6-48376, the flanges of the sectional plates are joined via joining means joints) to the edge of the rear end of the panels. Thus, large number ofjoints must be used, making the structure complex and expensive.

OBJECTS AND SUMMARY OF THE INVENTION

The object of the present invention is to provide a foldable boat that has a simple structure, that can be assembled quickly, that can be folded in a compact manner, and that allows safe movement on the boat.

In order to achieve the object described above, a foldable boat according to the present invention includes a rigid member for maintaining the hull and a waterproof member. The rigid member, which forms at least the bottom surface, includes a hull-forming member for forming the outer shape of the hull. The hullforming member is divided up from the bow to the stern. The bottom-forming members have projections and cavities that interlock between adjacent members. A plurality of flexible joining members is tightened so that the hull-forming members are pressed tightly against each other.

According to the present invention, a hull-forming member is fitted and tightened by pulling on ajoining member, thus forming a rigid hull and providing a comfortable boat. By using the joining member, the hull-forming member is separated and can be folded compactly, rolled, or stacked. This makes the hullforming member portable and minimizes the required storage space.

Briefly stated, a foldable boat has a hull divided into at least three sections; one of which includes at least one hull forming member. Each hull forming member has a bottom forming member with side forming members rotatably mounted thereon. Flexible members extend through the hull forming members and attach on the other remaining two sections of the hull. When the flexible members are pulled and fastened, the hull forming members are forced together thereby forming a hull. When the flexible members are not attached, the boat can be folded and transported easily. The side forming members are foldable flat against their respective bottom forming members and adjacent bottom forming members are foldable flat against each other to provide a compact folded configuration.

According to an embodiment of the invention, a foldable boat includes a waterproofing means and a hull divided into at least a first, second, and third sections. The second sections have at least one hull forming member. The hull forming members each have a bottom forming member and at least two side forming members rotatably mounted to the bottom forming member. A holding means is used for holding the side forming members substantially perpendicularly to the bottom forming members. The hull forming member further has at least one opening for receiving a plurality of flexible members. The flexible members extend through the openings. The first and third sections have fixing means for fixably attaching ends of the flexible members. In this way, if the plurality of flexible members are pulled toward one of the first and second sections, the hull forming member and the first and third sections are rigidly forced together.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
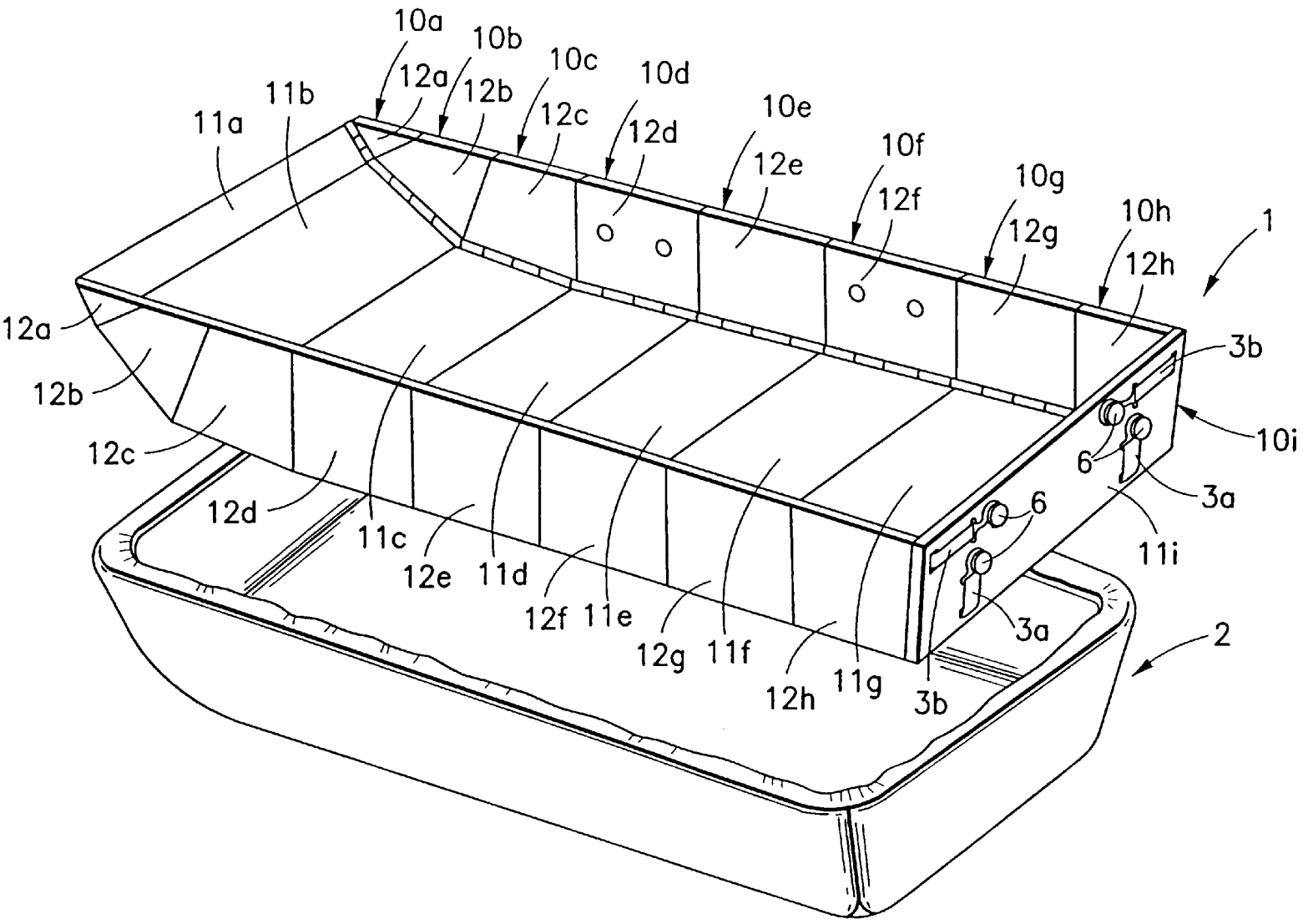
FIG. 1 is a perspective drawing showing an embodiment of a foldable boat according to the present invention.
Figure 2:
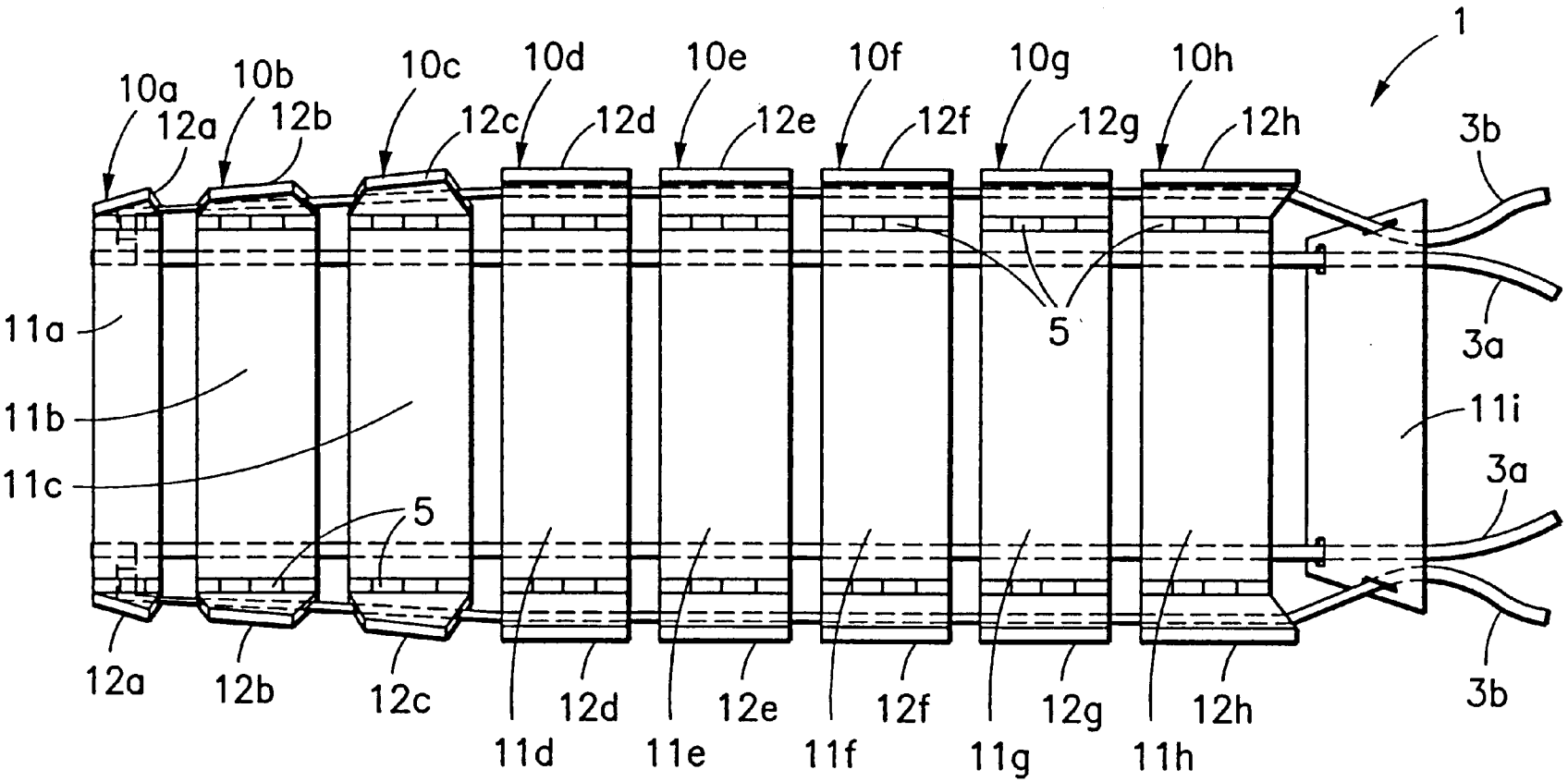
FIG. 2 is a top view showing the manner in which the hull-forming member is joined.

Referring to FIGS. 1 and 2, the foldable boat in this embodiment includes an outer hull plate 1 and a waterproofing member 2, which covers over the outside of outer hull plate 1 to provide waterproofing. Waterproofing member 2 is formed from a waterproof plastic film or a plastic sheet formed directly on the outer surface of the boat. Alternatively, waterproofing member 2 can be provided through a waterproof surface coating, rubber, or the like applied or impregnated to a sheet formed on the outer form of the bottom of the boat. Hull-forming members 10*a*, 10*b*, 10*c*, 10*d*, 10*e*, 10*f*, 10*g*, 10*h*, 10*i* are tightened via flexible members 3*a*, 3*a*, 3*b*, 3*b*. Hull-forming members 10*a*, 10*b*, 10*c*, 10*d*, 10*e*, 10*f*, 10*g*, 10*h*, 10*i* are assembled into a rigid structure so that each hull-forming member is tightly disposed against adjacent hull-forming members.

Hull-forming members 10*a*–10*h* each include bottom-forming members 11*a*–11*h* and left and right side-forming members 12*a*–12*h*. In other words, hull-forming member 10*a* for the bow includes bottom-forming member 11*a* and left and right side-forming members 12*a*, 12*a*. Second hull-forming member 10*b* includes bottom-forming member 11*b* and left and right side-forming members 12*b*, 12*b*. The n-th hull-forming member 10*n* includes bottom-forming member 11*n* and left and right side-forming members 12*n*, 12*n*. Hull-forming member 10*i* for the stern includes only stern-forming member 11*i*. In the following explanation, descriptions of the hull-forming members, bottom-forming members and side-forming members that are common to all the members will be referred to as hull-forming member 10, bottom-forming member 11, and side-forming members 12 (for left and right sides).

Figure 3:
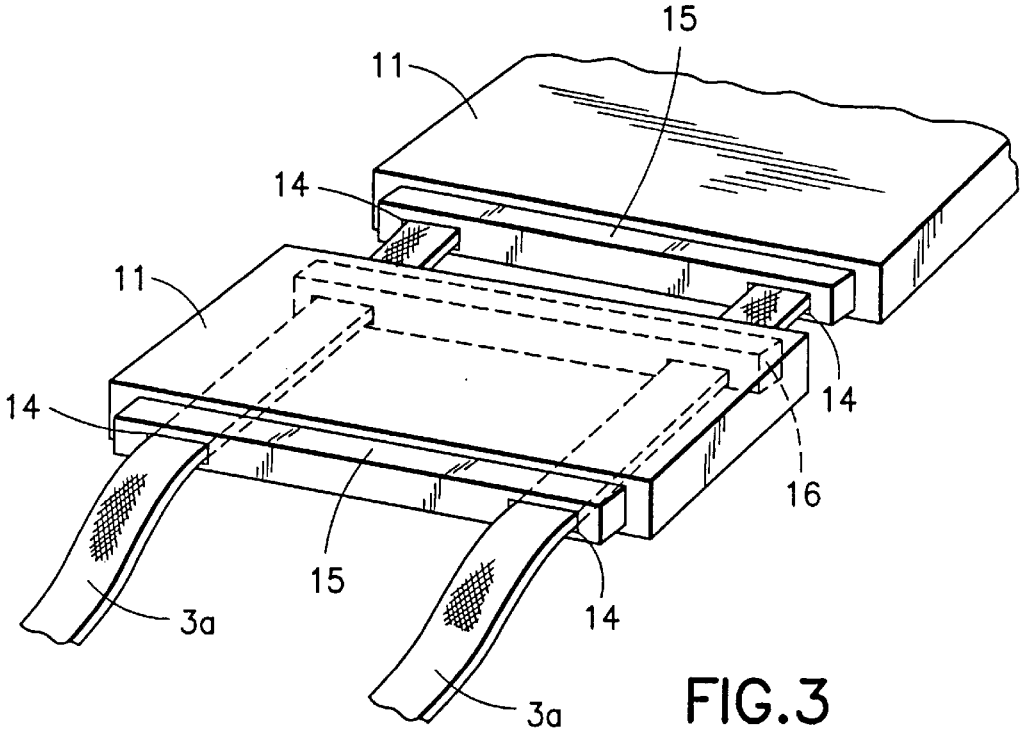
FIG. 3 is a perspective drawing for the purpose of describing how to join the foldable boat rigidly.

Referring now to FIG. 3, bottom-forming member 11 has holes 14, 14 disposed at the ends and oriented in the same direction as a longitudinal length of the boat. Flexible members 3*a* pass through holes 14, 14 from the bow to the stern. Bottom-forming members 11*b*–11*i* have projections 15 disposed toward the stern, and cavities 16, which mate with projections 15, toward the bow. A projection is not formed at the end of bottom-forming member 11*a*, which forms the edge of the bow. Similarly, the stern, with bottom-forming member 11*i*, is not formed with a cavity on its upper side, the edge of the stern. Bottom-forming member 11 is a rigid structure formed from, for example, an alloy plate of light metals such as aluminum, titanium, or the like; rigid wood; plastic; fiber-reinforced plastic (FRP); or the like. The plastic used in the fiber-reinforced plastic (FRB) mentioned above can be a known plastic such as epoxy resin, polyester resin, polyethylene resin, or the like reinforced with glass fiber, carbon fiber, or the like. This provides easy movement in the boat.

Figure 4A:
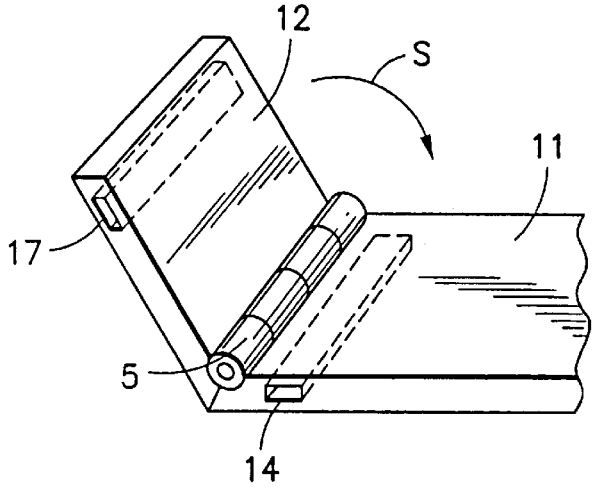
FIGS. 4(*a*) and 4(*b*) are perspective drawings of a section of the hullforming member of the foldable boat for the purpose of describing how the hullforming member is joined.
Figure 4B:
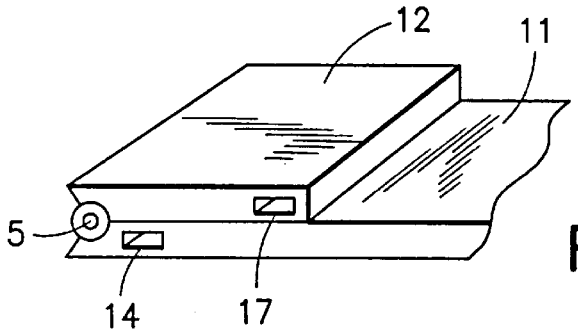

Referring to FIGS. 4(*a*) and 4(*b*), left and right side-forming members 12 are rotatably attached via hinges 5 at both sides of bottom-forming member 11. As with bottom-forming member 11, side-forming members 12 are also formed from rigid wood, fiber-reinforced plastic (FRP), or a light metal alloy plate aluminum, titanium, or the like. A strong boat is assembled by forming sideforming members 12 so that they are capable of forming a rigid structure by fitting or engaging with each other. A hole 17, for flexible member 3*b*, is disposed at least at one end of side-forming member 12.

Figure 5:
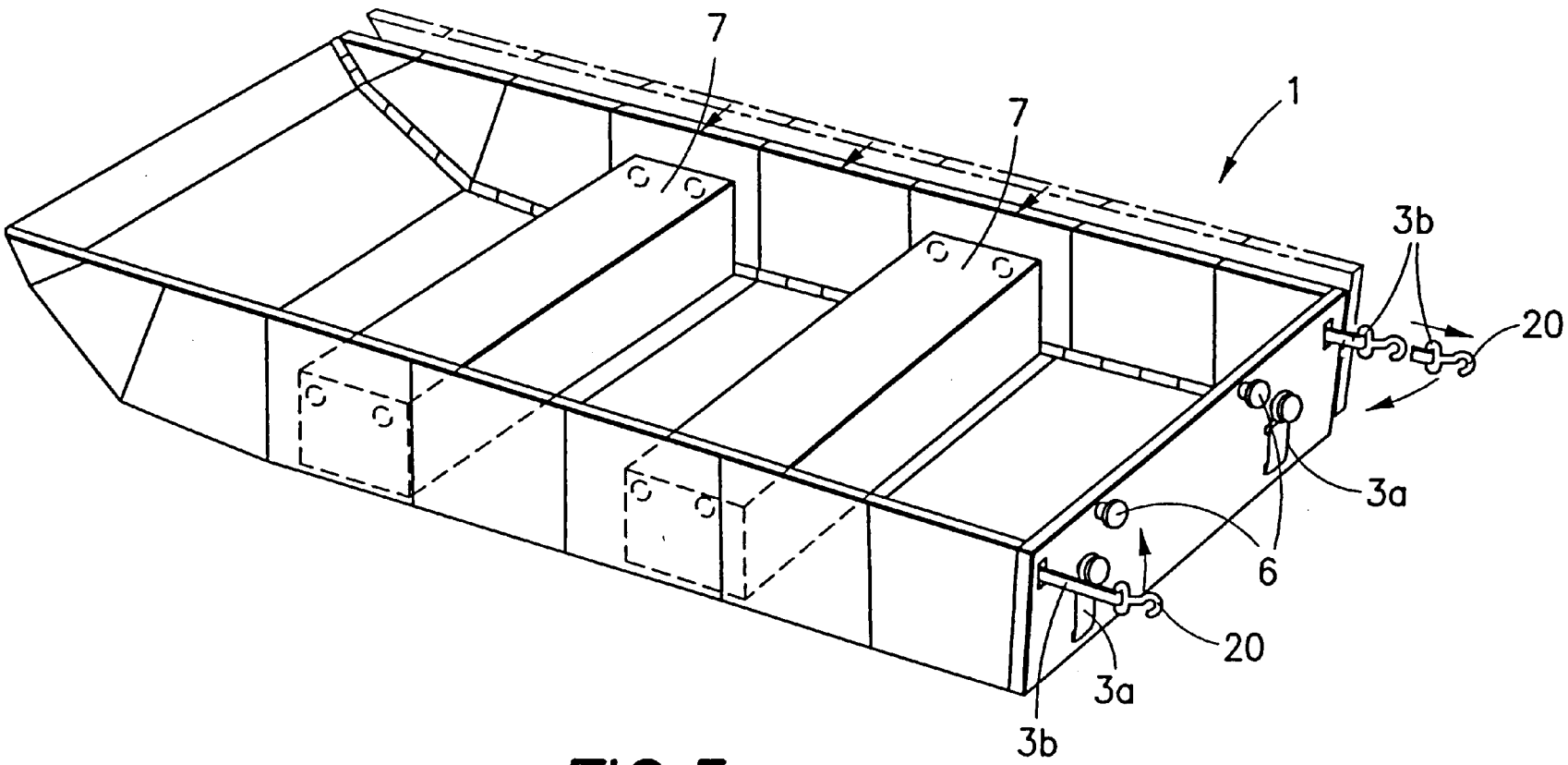
FIG. 5 is a perspective drawing showing an example of how the hull of the foldable boat can be assembled.

Referring back to FIGS. 1 and 2, holes are also disposed at the bottom and the upper edge of stern-forming member 11*i*, which is disposed at the end of flexible members 3*a*, 3*b*. The holes in stern-forming member 11*i* go through the member along the thickness axis and are aligned with holes 14 of bottom-forming member 11 and holes 17 of side-forming members 12 respectively. As can be discerned from FIG. 5, by pulling flexible member 3*a* toward the stern, adjacent bottom-forming members 11 are brought together tightly. By pulling flexible member 3*b* also toward the stern, the sides of the hull are lifted up. The sides are joined tightly to form the boat in the shape of a box. By forming the sides of the hull in this manner, flexure along the bow and the stern of the boat is eliminated and a rigid structure is provided for the boat.

Flexible members 3*a*, 3*b* can be formed, depending on the material, as tape, rope, thin plates, chains, or the like. There are no special restrictions on the material, and the members can be a material that is plastic, metal, natural fibers, synthetic fibers, metallic wire, or combinations thereof as appropriate. A rope made of synthetic fiber or twisted metal wire or the like is desirable due to the lightness, strength, and the fact that the material could be firmly tightened. The hull is formed by pulling on flexible members 3*a*, 3*b*. The ends of flexible members 3*a*, 3*b* are then tied or mounted on stern forming member 11*i*. This prevents the members from loosening and the boat from coming apart. Furthermore, the boat is also prevented from becoming deformed easily. It is desirable to dispose a wrapping tool, a tightening piece, a fastening tool, an engagement member 6, or the like at the stern. Thus the bonds between bottomforming members 11 and side-forming members 12 can be strengthened simply by tightening the flexible members.

Figure 6:
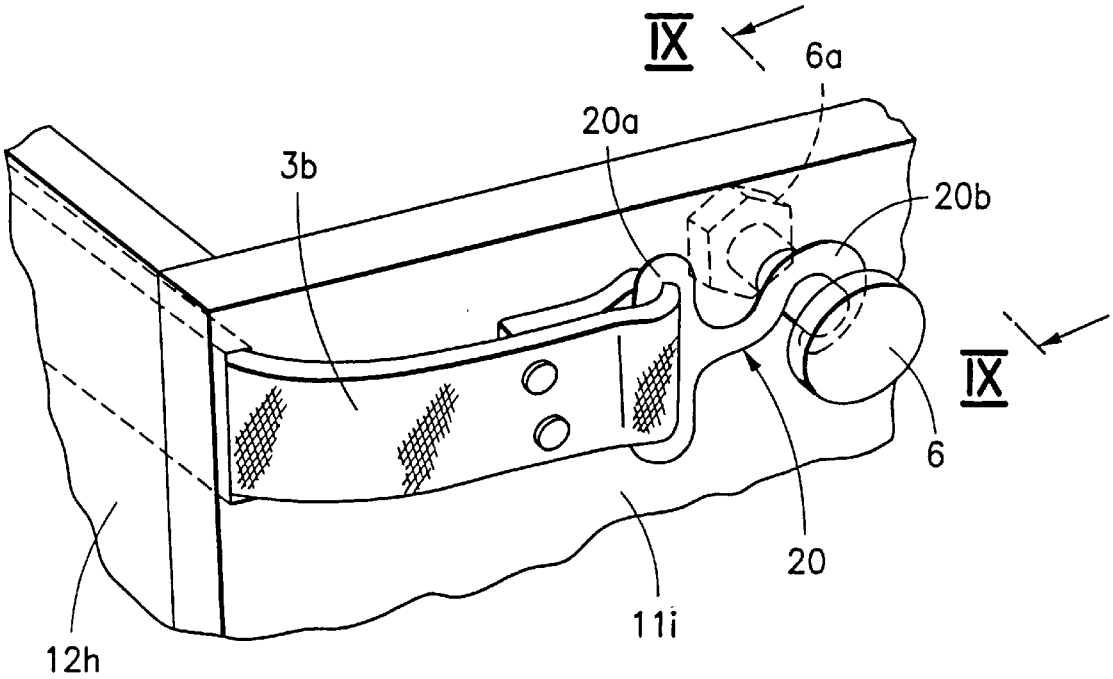
FIG. 6 is a perspective drawing for the purpose of describing the tightening piece.
Figure 7:
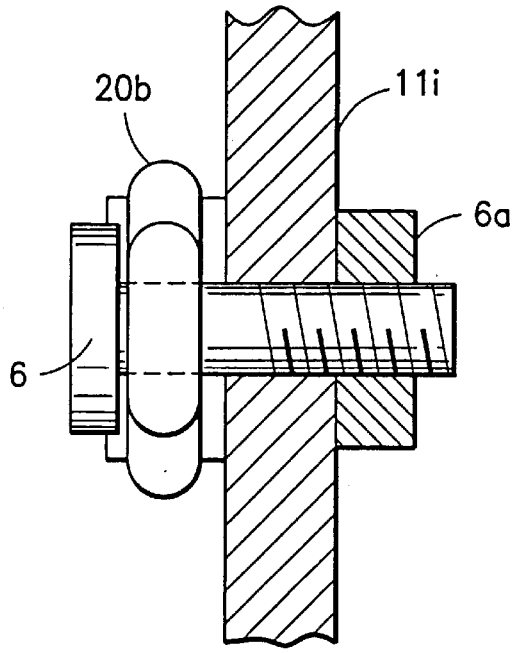
FIG. 7 is a cross-section drawing of FIG. 6 for the purpose of describing an engagement section for engaging the tightening piece.

Referring to FIG. 6 and FIG. 7, the tightening mechanism for tightening flexible members 3*a*, 3*b* involves fixing ends of flexible members 3*a*, 3*b* to an engagement section 20*a* of a hook 20. Hooked section 20*b* is hooked onto an engagement member 6. Engagement member 6 is attached to stern forming member 11*i* via an attachment member 6*a* which is a bolt or the like. Then, flexible members 3*a*, 3*b* are pulled and tightened to tighten hull-forming member 10. By hooking the hook at the ends to engagement member 6 disposed on stern-forming member 11*i*, the hull-forming members are fixed, and the rigidity toward the stern and toward the sides is reinforced.

The following is a description of the assembly process of the foldable boat described above. Referring to FIGS. 1–7, hull-forming members 10*a*, 10*b*, 10*c*, 10*d*, 10*e*, 10*f*, 10*g*,

10*h*, 10*i* are formed in the following manner. Bottom-forming members 11*a*–11*i* are formed in prescribed shapes. In bottom-forming members 11*a*–11*i* are holes 14, for flexible members 3*a*, projections 15, and cavities 16. Side-forming members 12*a*–12*h* are formed in prescribed shapes and in them are holes 17 for flexible members 3*b*. Hull forming member 10 is then formed by rotatably connecting bottom-forming member 11 and side-forming member 12 via hinge 5.

Next, flexible members 3*a*, 3*b* are fixed to hull-forming member 10*a* at the bow. Flexible members 3*a*, 3*b* are inserted through holes 14, 17 of hull-forming members 10, and then through the holes formed on stern-forming member 11*i*. The ends of flexible members 3*a*, 3*b* are pulled so that adjacent hull-forming members 10 are pressed tightly against each other, and the fitting sections formed by projections 15 and cavities 26 are fitted together. Then, the ends of flexible members 3*a*, 3*b* are fixed so that flexible members 3*a*, 3*a* are fixed together and flexible members 3*b*, 3*b* are fixed together, thus forming outer hull plate 1. Alternatively, the flexible members can be hooked on to stern forming member 11*i*.

Figure 8:
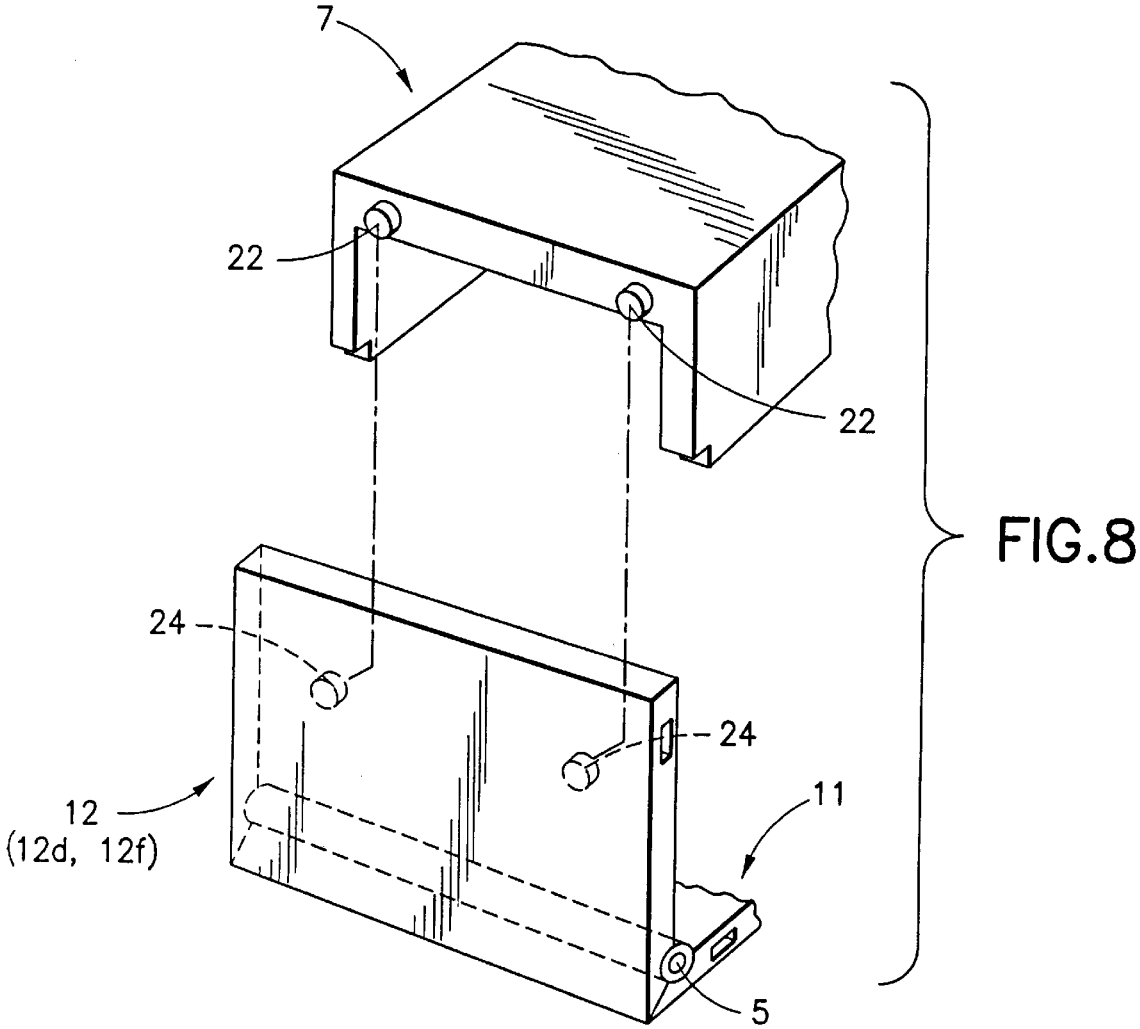
FIG. 8 is a perspective drawing showing an example of how the reinforcement seat is attached.
Figure 9:
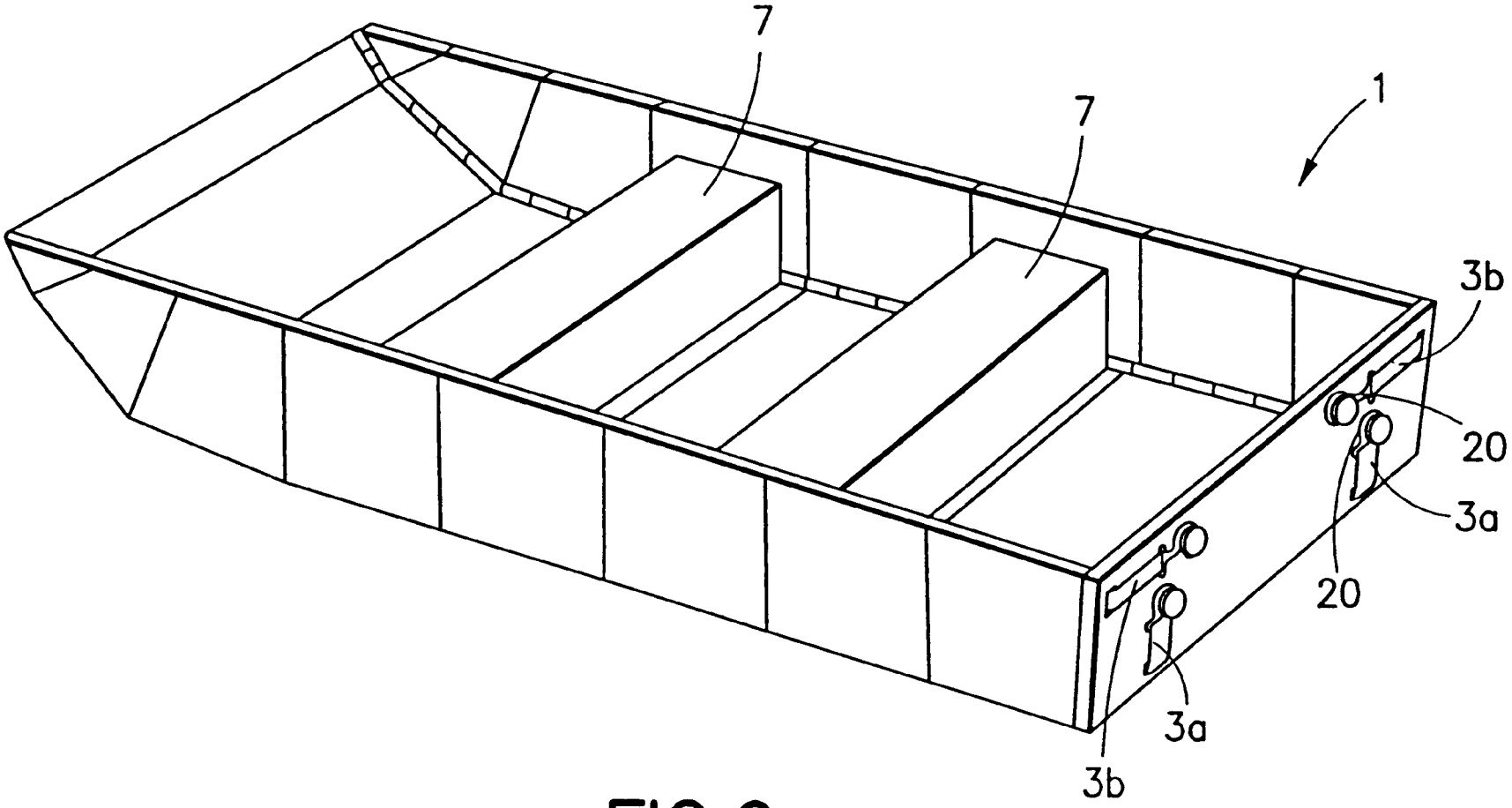
FIG. 9 is a perspective drawing showing the hull in an assembled state.

Next, the bottom of outer hull plate 1 is covered with waterproof member 2 formed according to the outer shape of the bottom of the boat. The upper edge of waterproof member 2 is attached to side-forming members 12 to complete the assembly of the foldable boat. It is desirable for the outer shape of the waterproof member to be matched closely to the shape of the hull to minimize wrinkling, thus decreasing resistance from water. Referring to FIGS. 8 and 9, when necessary, reinforcement seats 7, 7 can be attached to maintain the rigidity of the hull. In this example, an engagement member 22 is disposed on reinforcement seat 7. Engagement holes 24 are disposed on side-forming members 12 of the hull. Engagement member 22 is fitted to engagement hole 24 to attach reinforcement seat 7.

Figure 10:
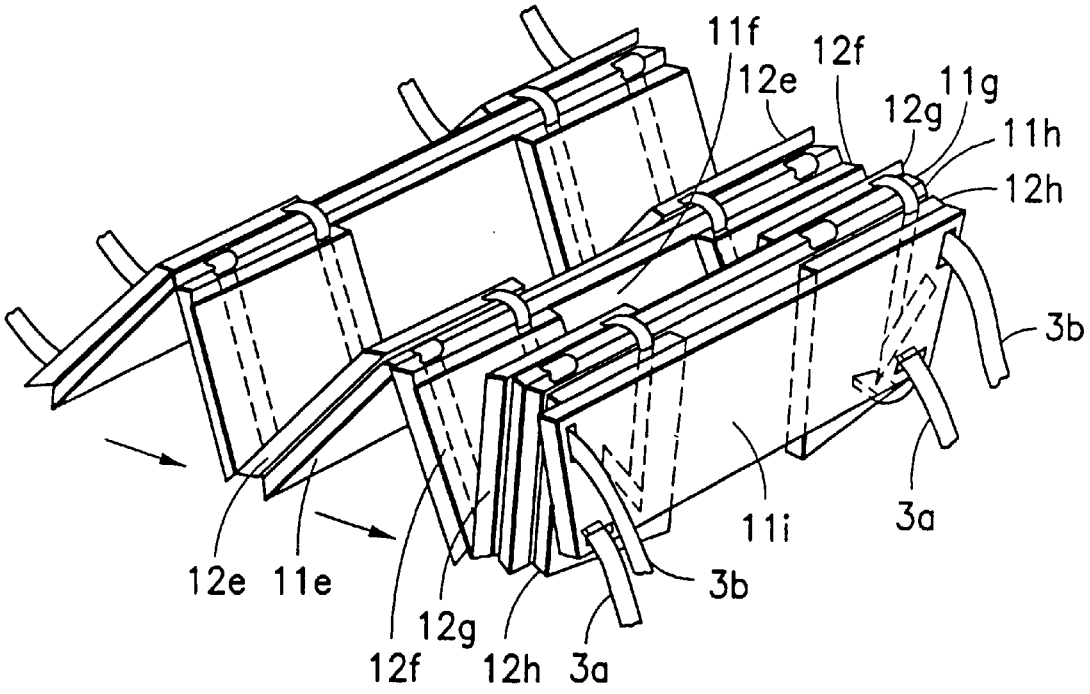
FIG. 10 is a perspective drawing showing an example of how the foldable boat can be folded.

The following is a description of how to store the foldable boat assembled in the above presentation. First, waterproof member 2 is removed from outer hull plate 1. Then, flexible members 3*a*, 3*b* are loosened, and hull-forming members 10*a*–10*h* are taken apart. In this case, flexible members 3*a*, 3*b* are loosened without pulling them out from hull-forming member 10. Referring to FIGS. 4 (*a*) and 4(*b*), side-forming members 12 are rotated in the direction indicated by arrow S. Referring to FIG. 10, folded hull-forming member 10 is then folded like an accordion. Flexible members 3*a*, 3*b* left over after the folding are wrapped around so that they do not loosen. The boat is then stored. Using this method for storing, a boat-folding member 10 that is 3 meters long and folded into eight pieces can be stored in a space with dimensions W 1.0 m×D 0.5 m×H 0.4 m.

As described above, in the foldable boat according to the present invention, hull-forming member 10 is formed from foldable bottom-forming member 11 and side-forming members 12. Hull-forming member 10 is formed so that it can be taken apart. Flexible members 3*a*, 3*b* are used to tighten bottom-forming member 11 and side-forming members 12. Thus, the structure of the boat is simple. The boat can be assembled and disassembled quickly, and can be folded compactly. Also, the boat is rigid once it has been assembled, thus providing a foldable boat that allows safe movement on the boat.

Figure 11:
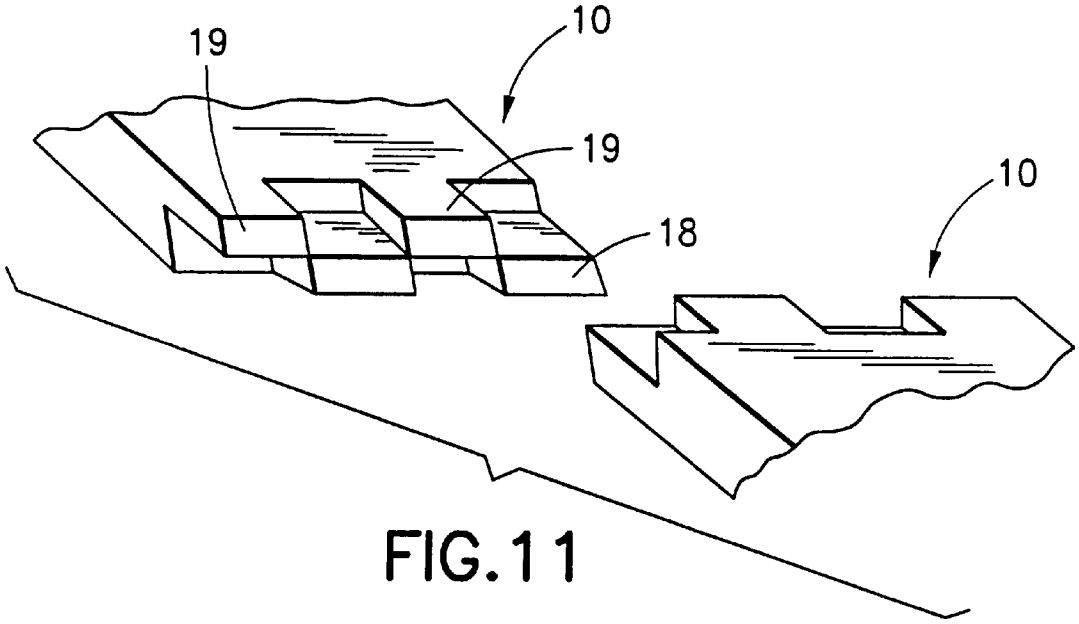
FIG. 11 is a perspective drawing for the purpose of describing an alternative method ofjoining the bottom section.

The present invention is not restricted to the description of the embodiment presented above. The present invention encompasses alternative embodiments that do not change the main elements of the invention. For example, in the description of the embodiment above, bottom-formning member 11 and side-forming members 12 are folded using a hinge. However, the two elements can be joined with a flexible member as well. Also, cavities and projections are formed on the bottom-forming members so that the cavities and projections of adjacent bottom-forming members fit against each other. Referring to FIG. 11, it is possible to form engagement projections 18 and engagement cavities 19 in a vertically alternating manner on one side of bottom-forming member 10. On the other side of adjacent bottom-forming member 10 are formed engagement projections 18 and engagement cavities 19 in a vertically alternating manner. Engagement projections 18 and engagement cavities 19 are then mated with each other. Also, it is possible to join the members using a foldable engagement member such as a hinge. Furthermore, it is possible to fix a shaft-shaped reinforcement member extending from the bow to the stern. In this case, it is possible to move in a stable manner in the boat with fewer frames compared to conventional boats that provide reinforcement through frames.

Figure 12:
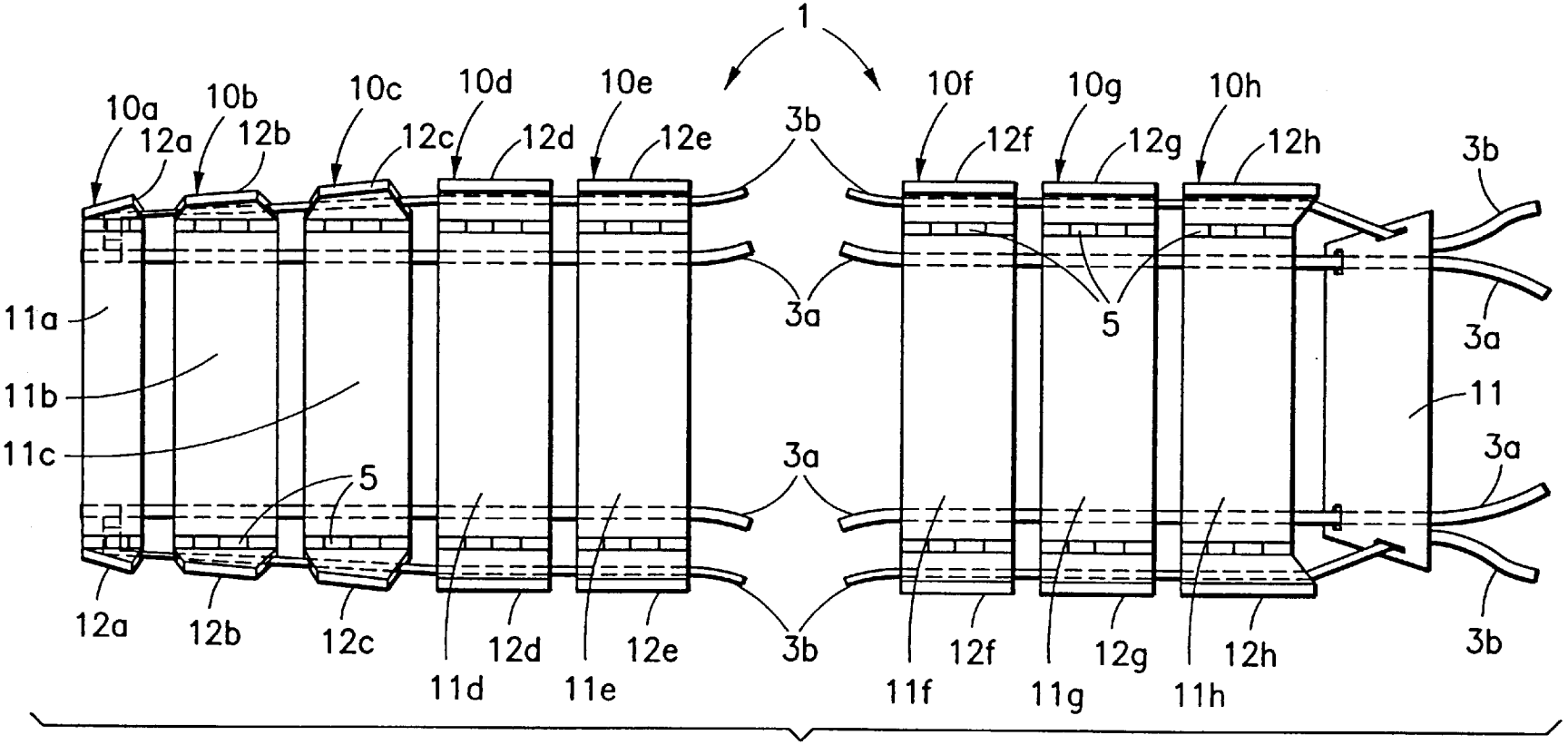
FIG. 12 is an exploded top view drawing for the purpose of describing an alternative joining method.

The number of flexible members to be used is not restricted to the number presented in the description above. The number can be more than or less than the number in the description. It is desirable to use four or more flexible members to provide strength and rigidity. Referring to FIG. 12, it is possible to split the flexible members into two or more segments along the axis from the bow to the stern, thus allowing the hull-forming members for the bow and the hull-forming members for the stern to be stored separately. This arrangement provides lighter folded members and is convenient for transporting the boat.

Figure 13:
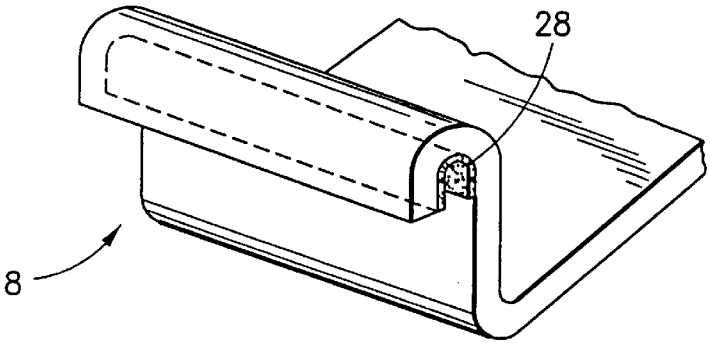
FIG. 13 is a perspective drawing of the attachment section for the purpose of describing an alternative method for reinforcing the hull.
Figure 14:
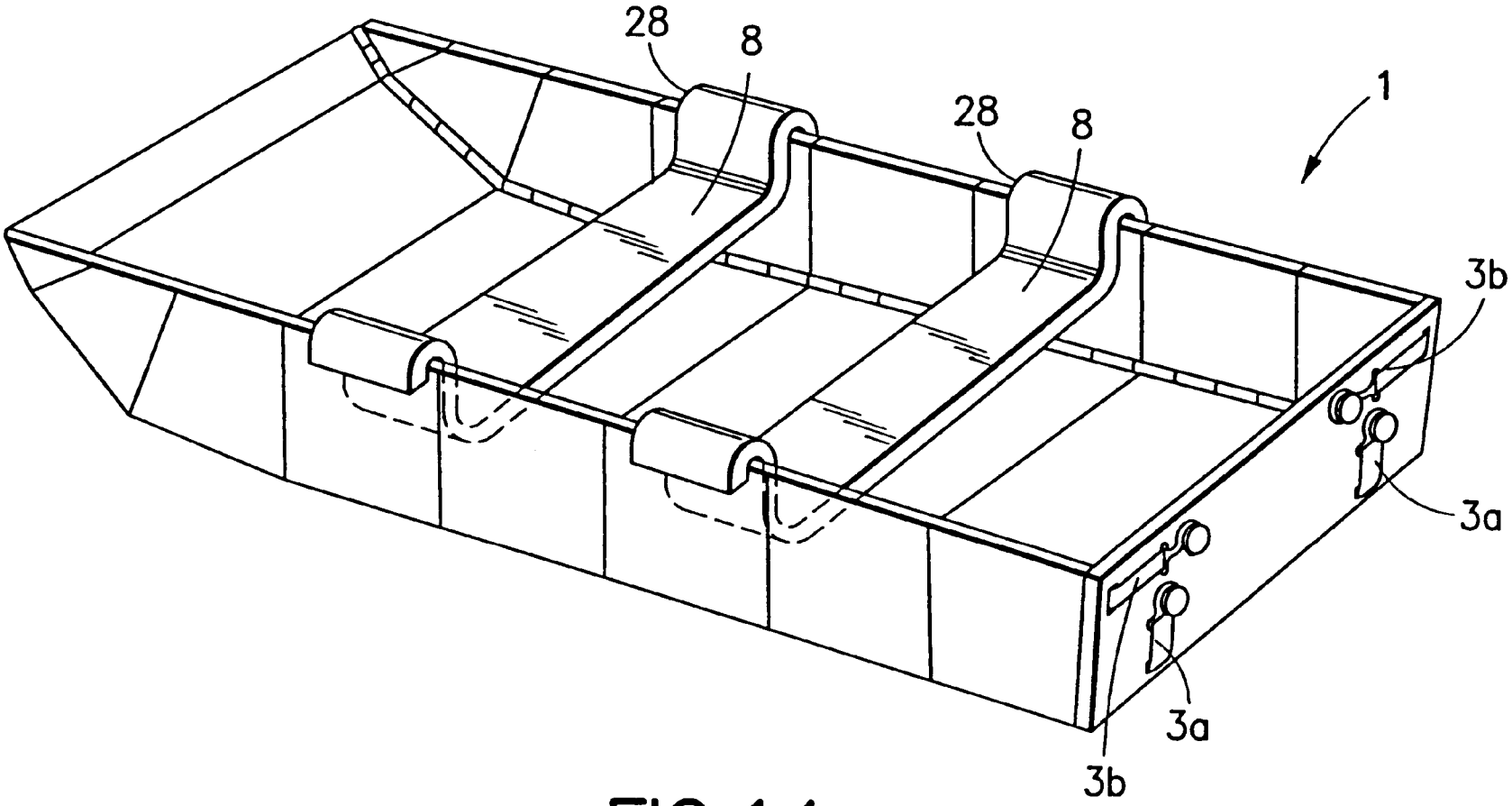
FIG. 14 is a perspective drawing of the hull-forming member for the purpose of describing an alternative method for reinforcing the hull.

Referring to FIG. 13 and FIG. 14, another method for reinforcing the lateral rigidity of the hull is to engage both ends of a plate-shaped seat member 8 with the top portions of two respective side forming members 12, thus restricting it from widening or narrowing laterally. In this case, a damping member 28 comprising rubber or the like can be interposed at the engagement section to prevent slippage. By engaging the sides of the boat with the ends in this manner, further lateral reinforcement is provided.

Figure 15:
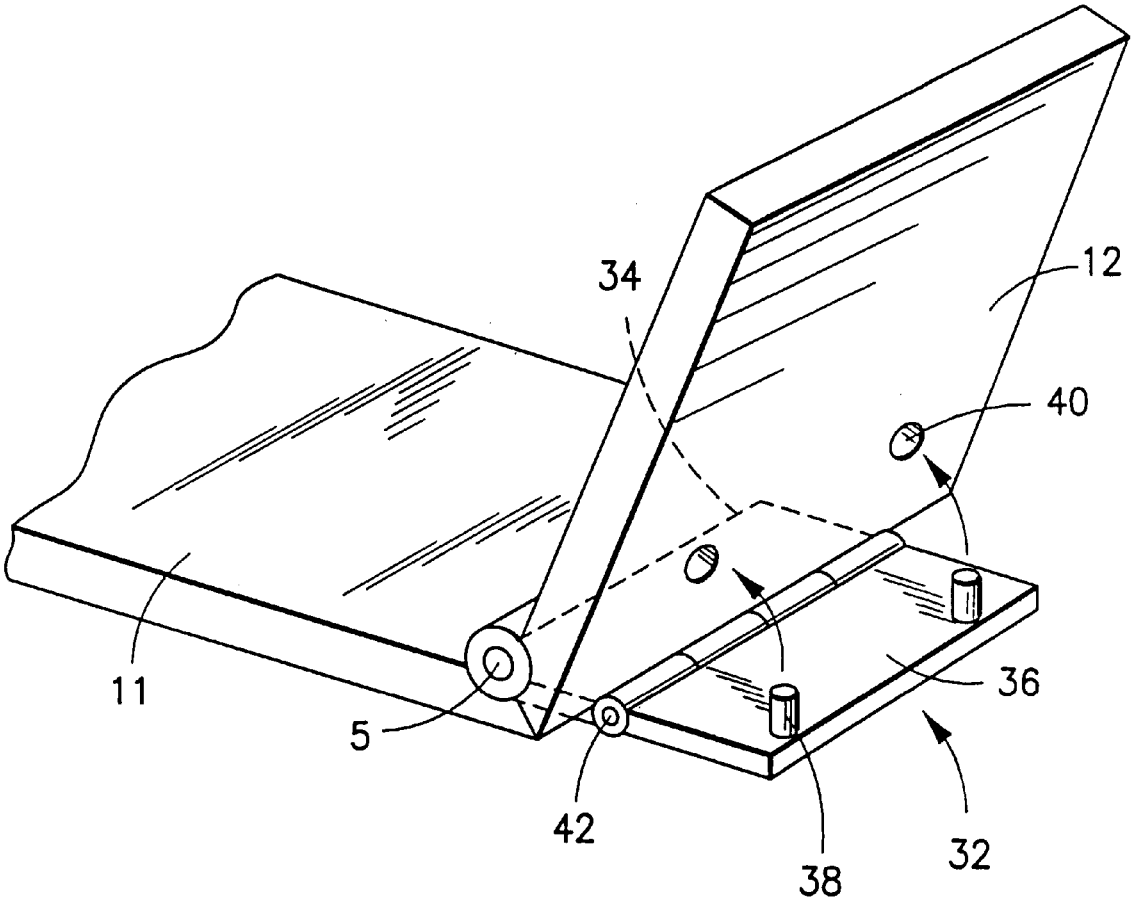
FIG. 15 is a perspective drawing for the purpose of describing yet another method for reinforcing the hull.
Figure 16:
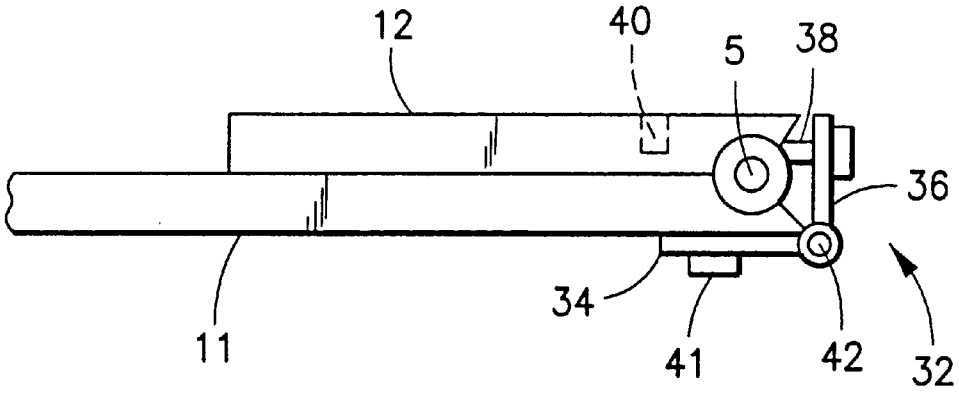
FIG. 16 is a side-view drawing showing how the hull-forming member is folded according to the reinforcement method shown in FIG. 15.
Figure 17:
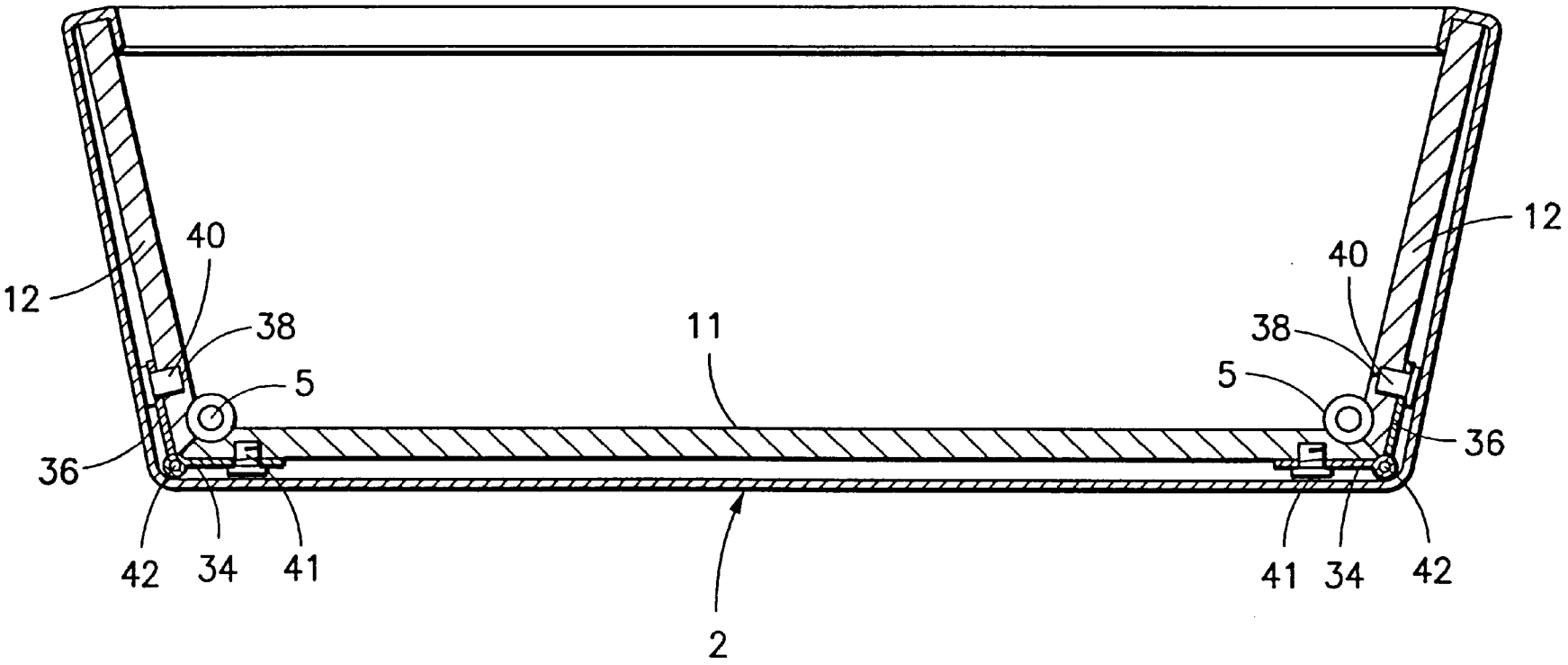
FIG. 17 is a side cross-section drawing for the purpose of describing the assembly of the hull according to the reinforcement method shown in FIG. 15.

Referring to FIG. 15–FIG. 17, in forming the hull, it is also be possible to have a reinforcement member 32 disposed outside the hull in order to maintain the rigidity of bottom-forming member 11 and side-forming member 12. This reinforcement member 32 is formed from a hull attachment member 34 and a movable member 36 that rotates around a connecting shaft 42. A screw member 41 is used to attach hull attachment member 34 to bottom-forming member 11 or side-forming members 12. When the hull is being formed, rotating member 36 serves to prevent pivoting of either side-forming member 12 or bottom-forming member 11, whichever is not attached to hull-attachment member 34. Rotating member 36 has an engagement member 38, which engages with an engagement member 40 formed on either side-forming member 12 or bottom-forming member 11.

A pressing member, not shown in the drawings, may also be disposed to be continuously pressing movable member 36 so that bottom-forming member 11 and side-forming member 12 are pressed toward each other. As described above, the ends of flexible members 3*a*, 3*b* (not shown in the drawing) are pulled so that adjacent hull-forming members 10 are pressed tightly against each other and so that the fitting sections are fitted against each other. Then, flexible members 3*a* are tied to each other, or hooked on to stern forming member 11*i*, and flexible members 3*b* are tied to each other, or similarly hooked, thus forming outer hull plate 1. Then, engagement member 38 of movable member 36 is engaged with engagement member 40. Next, the bottom of outer plate 1 is covered with waterproof member 2, which is formed according to the outer shape of the bottom of the boat. The upper edge of waterproof member 2 is attached to the side-forming members, thus completing the foldable boat.

The method for waterproofing is not restricted to the example shown in the drawings, where a thick waterproof sheet is used to cover the entire hull. It is desirable to use a thin waterproof sheet. Furthermore, it is also desirable to connect the members to each other using a waterproof member such as a stretchable waterproof sheet or the like. By mounting a stretchable waterproof sheet, water resistance can be established as soon as the boat is assembled. This makes storage somewhat inconvenient but has the advantage of making assembly easier. If a part of or the entire stretchable waterproof member connecting the members is made removable, the waterproof member can be stored more compactly compared to a waterproof member that covers the entire boat. In the present invention, the waterproof member can be any of well-known waterproof items such as members formed from rubber, rubberized material, plastic and the like.

In the embodiment described above, a hinge is used to connect the bottom-forming member and the side-forming member, but the hinge in the present invention is not restricted to what is shown in the drawings. It is also possible to use a plurality of hinges separated by intervals. It is also possible for the waterproof material such as a flexible waterproof sheet contributes to the joining. Also, it is possible to provide the joints solely using the waterproof material such as a flexible waterproof sheet.

As described above, a hull-forming member is divided into at least three divisions going from the bow to the stern, with at least the bottom surface of the hull being rigid. On the hull-forming members are formed interlocking projections and cavities, where the interlocking takes place between adjacent members. On the hull-forming members are also formed a plurality of holes through which a plurality of flexible joining members are slidably disposed. The joining members are fixed on one end to a single hull-forming member between the bow and the stern. The joining members are formed so that they can be tightened at the other end in order to press the hull-forming members against each other. Furthermore, since the hull-forming members are connected to each other using the flexible members, the hull-forming members can be stacked for storage. Thus, the boat can be folded or wrapped in a bundle so that the outer dimensions are small. This means the boat takes up less space and allows the boat to be easily transported. By pulling the flexible members tight when forming the boat, the projections and the cavities of adjacent hull-forming members are fitted together. Thus, there is no need to fit the individual joints separately, which makes the boat easy to assemble. Once fitting is complete, the members are rigidly connected to form the equivalent of a rigid structure, thus providing a comfortable boat.

If the hull-forming members described above are bendable side-forming members, the hull can be formed even more rigidly. The members can be bent to make the boat smaller for storage, thus making the boat convenient for transporting and storage.

If the waterproof member described above comprises a waterproof sheet covering the outer surface of the hull, the boat can be made lighter and can be folded to smaller dimensions. This allows the boat to be stored in a smaller space, thus making the boat convenient for transporting and storage. The waterproof member can also be a waterproof sheet interposed in a water-tight manner between the hull-forming members to connect the members. Thus, a separate waterproof sheet does not need to be used, and the structure of the boat is made more simple.

As the description above makes clear, the foldable boat according to the present invention provides a simple structure, is easy to build, is easy to take apart, and can be folded to a small dimension. Also, since the foldable boat is rigid after assembly, movement on the boat can be performed easily.

In the present invention, "fitting" signifies, in addition to simple fitting methods, engagement, meshing and the like, where two members are joined so that there is a significant degree of tightness. The method for tightening the flexible tightening member can comprise methods for tightening using rope, wire, belts, and the like where tightening is performed by: the tying of the members; locking so that friction is increased, thus preventing loosening; fixing the end to a hook and hooking the hook; or maintaining a tightened state through engagement or gripping.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A foldable boat comprising: waterproofing means;

a hull divided into at least a first, second, and third sections; said second section having at least one hull forming member;

said at least one hull forming member each having a bottom forming member with at least two side forming members rotatably mounted thereon;

keeping means for keeping said side forming members at an angle such that said side forming members are at least generally coplanar with respect to said bottom forming members;

said at least one hull forming member further having at least one opening for receiving a plurality of flexible members;

said plurality of flexible members extending through said at least one opening;

at least one of said first and third sections having fixing means for fixably attaching ends of said plurality of flexible members; and whereby if said plurality of flexible members are pulled toward one of said first and said third sections, said first, second, and third sections are rigidly forced together.

2. The foldable boat as in claim 1 wherein said waterproofing means is a waterproofing member disposed coextensively with said hull and a waterproof sheet connecting and interposed between said hull forming.

3. The foldable boat as in claim 1 wherein:

said keeping means includes a stern forming member;

said stern forming member forms said first section; and said stern forming member is disposed at an angle such that said stern forming member is at least generally coplanar with respect to said bottom forming member.

4. The foldable boat as in claim 1 wherein said keeping means is a seat member placed upon two side forming members.

5. The foldable boat as in claim 1 wherein:

one of said first section and said third section has at least one cavity on one side;

the other of said first section and said third section has at least one projection on one side;

each of said hull forming members has at least one cavity on one side and at least one projection on an opposing side; and said cavities and projections are effective to mate with one another;

whereby if said flexible members are pulled toward one of said first and said third sections, said first, second, and third sections are further rigidly forced and held together.

6. The foldable boat as in claim 1 wherein said fixing means comprises:

a projection disposed upon one of said first and third sections; and a hook attached to one of said ends of said flexible members.

7. The foldable boat as in claim 1 wherein said keeping means comprises:

a reinforcement member having a fixed portion and a moveable portion;

said fixed portion being mounted to one of said bottom forming members and said side forming members; and said moveable portion effective to be detachably mounted to the other of said bottom forming members and said side forming members when said foldable boat is in a completed position whereby said side forming members are further supported at an angle such that said side forming members are at least generally coplanar with respect to said bottom forming members.

8. A foldable boat as in claim 1 wherein said keeping means includes at least one flexible member extending through at at least one hole disposed in said at least two side members.

9. A foldable boat as in claim 1 wherein said side forming members are rotatably mounted to said bottom forming members with hinges.

10. A foldable boat as in claim 1 wherein said side forming members are pliant portions extending outwardly from said bottom forming members.

* * * * *